United States Patent [19]

Dreinhoff et al.

[11] 4,406,554

[45] Sep. 27, 1983

[54] END OF RIBBON INDICATOR FOR A TYPEWRITER RIBBON CASSETTE

[75] Inventors: Karl-Heinz Dreinhoff, Berlin; Hermann Wambach, Unterhaching, both of Fed. Rep. of Germany

[73] Assignee: Siemens Aktiengesellschaft, Berlin & Munich, Fed. Rep. of Germany

[21] Appl. No.: 323,414

[22] Filed: Nov. 20, 1981

[30] Foreign Application Priority Data

Dec. 2, 1980 [DE] Fed. Rep. of Germany ..... 3045461

[51] Int. Cl.[3] ..... B41J 35/36

[52] U.S. Cl. ..... 400/249; 400/208; 400/234; 400/236

[58] Field of Search ..... 400/207, 208, 208.1, 400/234, 248, 236, 249; 242/197, 198, 199, 200

[56] References Cited

U.S. PATENT DOCUMENTS

| | | | |
|---|---|---|---|
| 2,365,254 | 12/1944 | Dolan | 400/249 X |
| 3,520,495 | 7/1970 | Sotani | 242/199 X |
| 3,619,625 | 11/1971 | Wood | 242/199 X |
| 4,058,197 | 11/1977 | West | 400/208 |
| 4,299,504 | 11/1981 | Benz et al. | 400/208 |
| 4,317,636 | 3/1982 | Hume | 400/208 |
| 4,347,007 | 8/1982 | Schaefer | 400/208 |

FOREIGN PATENT DOCUMENTS

| | | | |
|---|---|---|---|
| 35771 | 9/1981 | European Pat. Off. | 400/208 |
| 1585245 | 2/1981 | United Kingdom . | |

*Primary Examiner*—Ernest T. Wright, Jr.

*Attorney, Agent, or Firm*—Hill, Van Santen, Steadman & Simpson

[57] ABSTRACT

A typewriter ribbon cassette contains a feed spool and a take-up spool which are both displaceably arranged in guide slots in the cassette housing. The guide slot for the feed spool leads to a control corner edge opening into an enlarged recess. The feed spool is biased with a spring force towards the control edge of the slot during unwinding of the ribbon roll, so that, when the feed spool has overrun the control edge, the spool is pivoted into a switching position which can be detected by a monitoring device for signalling an end of tape state of the ribbon roll. The hub of the feed spool is provided with a guide pilot for sliding along the guide slot which has a cornered plan profile for holding the hub in a straight line path along the slot until after the control edge is overrun.

12 Claims, 5 Drawing Figures

END OF RIBBON INDICATOR FOR A TYPEWRITER RIBBON CASSETTE

BACKGROUND OF THE INVENTION

The present invention relates to a typewriter ribbon cartridge or cassette assembly and, more particularly, to a switching device wherein at least one of the ribbon spools is displaceably arranged in a slot of the cartridge housing to indicate the end of the ribbon on that spool.

In conventional typewriters and similar office machines, typewriter ribbon wound on a supply spool in a cartridge passes in and out of the cartridge along a ribbon path between the supply spool and a take-up spool. The take-up spool usually has a portion thereof which is engaged by a drive mechanism on the typewriter to provide ribbon feed. In operation, it is necessary to inform the typist of the supply state of the ribbon on the spool being unwound and to indicate when the end of the supply of ribbon is reached so that the feed can be disconnected and the ribbon cartridge replaced.

British Specification No. 1,585,245, corresponding to German OS No. 2,820,266 and U.S. Ser. No. 801,286, filed May 27, 1977, describes a typewriter ribbon cartridge for typewriters which contains a feed spool having a fixed axis of rotation and a take-up spool having an axis of rotation movable along a guide path slot toward an access opening in that corresponding chamber of the typewriter ribbon housing. A viewing slot is provided so that the supply state of the ribbon on the supply spool can be readily observed. Further, it is conventional in the art of tape recorders to provide a switch device for detecting recording tape tension being threaded through the recording station in order to initiate disc connection of the recording operation when tape tension falls below a predetermined amount at the end of the tape supply.

The present invention is directed to a switching device for use with typewriter ribbon cartridges for typewriters, teleprinters, and similar office machines, which effects an accurate switching process for disconnecting the ribbon feed operation during the unwinding process at the end of the supply of ribbon.

SUMMARY OF THE INVENTION

A typewriter ribbon cartridge housing is provided with respective guide slots along which a supply spool and take-up spool correspondingly travel during the unwinding of typewriter ribbon. At least one of the guide slots is formed with a corner control edge portion leading to a relatively enlarged opening. A spring bias is connected to the spool traveling along the slot having the control edge for biasing the spool towards the enlarged opening during ribbon movement operation. Guide pilots are formed on the spool hub for passing the spool about the control edge under action of the spring force into a switching position, whereupon the spool is detected by means of a monitoring device for disconnecting automatic ribbon feed operation.

In accordance with the preferred embodiment, the guide pilot means possesses a straight sliding surface for running along the guide slot and a lateral trailing face surface which defines a switching or limit edge. When the switching edge moves past the control edge the spool passes into the enlarged opening and the switching operation occurs. The present invention can be used to signal the end of the tape supply to the operator or typist on the occurrence of the end of the tape when the spool being monitored overruns the control edge.

DESCRIPTION OF THE PREFERRED EMBODIMENT

Figure 1:
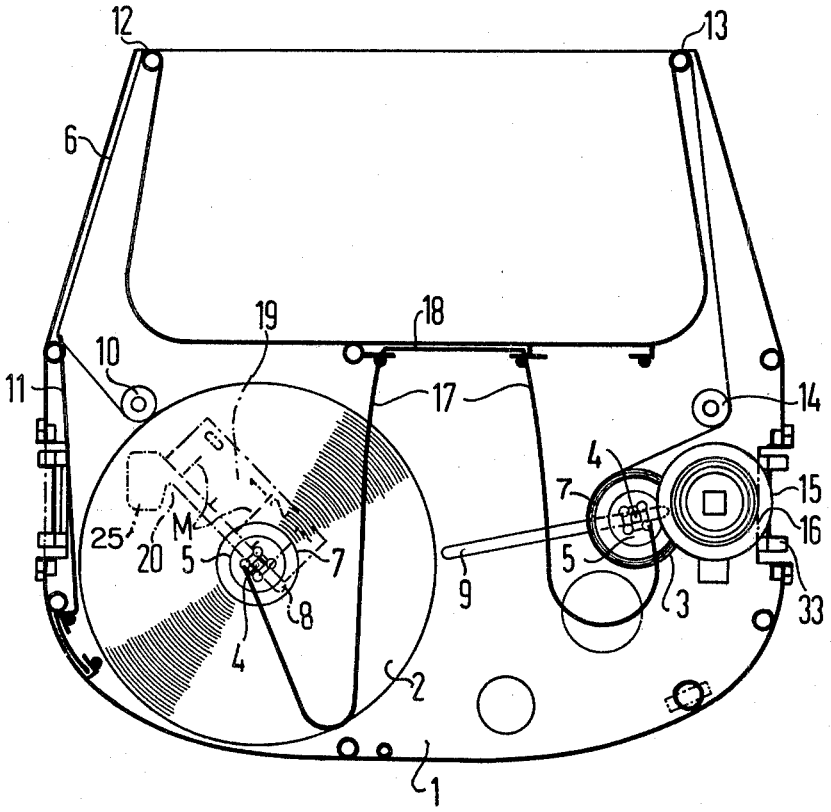
FIG. 1 is a plan view of a typewriter ribbon cassette housing constructed in accordance with the present invention, with the cover removed.

FIGS. 1–5 illustrate a ribbon cartridge housing 1, which may be in the form of a cassette, permitting replacement of typewriter ribbon in a typewriter, teleprinter, or other similar office machine. The housing 1, preferably made of plastic injection molding, contains a rotary feed spool 2 and a rotary take-up spool 3. Both the feed spool 2 and the take-up spool 3 are made up of hubs 5, each provided with guide pilots 4, and winding cores 7, which carry the actual ribbon 6 in layered rolls and are relatively rotatable on the hubs 5. The guide pilots 4 are guided in corresponding guide slots 8 and 9 running substantially diagonally in the cartridge housing 1. Similar slots corresponding to guide slots 8 and 9 may be formed in a cover (not shown) which fits over the cartridge housing 1.

From the feed spool 2, whose guide pilots 4 are mounted in the guide slot 8, the ribbon 6 is threaded around a guide roller 10 past a torsion spring means 11 which determines ribbon tension, around guide bars 12 and 13, about a further guide roller 14, and onto the winding core 7 of the take-up spool 3. The take-up spool 3 is cooperatively connected with a drive wheel 15, accessible from outside the cartridge housing 1 via a recess 16 formed in the housing sidewall. The drive wheel 15 is operated for rotation by a suitable drive system (not shown). Torque is transferred from the drive wheel 15 to the take-up spool 3 by a frictional driving engagement between the drive wheel 15 and the ribbon 6 being wound about the core 7 of the take-up spool 3. For this purpose, a sandpaper-like friction surface may be formed about the drive wheel 15 for engagement with the ribbon 6.

A biasing means 17 in the form of a curved, unitary spring clip is inserted in support holders 18 formed on the cartridge housing 1 to produce a resilient contact pressure between the ribbon roll of the feed spool 2 and the guide roller 10 and between the ribbon roll of the take-up spool 3 and the drive wheel 15. Corresponding free ends of the spring 17 are inserted in suitable connection openings 50 formed in the hubs 5 of the spools 2 and 3.

A pressure means 19 containing a foam material engagement piece, is fixed to the cover of the cartridge housing 1 for applying a brake torque on the feed spool 2. In addition, the spring 11 pulls upon the ribbon 6 to ensure a taught ribbon feed and provide a certain adjustment of the ribbon path.

Since both the feed spool 2 and the take-up spool 3 are displaceably arranged along guide slots 8, 9 in the housing 1, a particularly compact construction of the housing 1 is possible. The state of unwinding of the feed spool roll 2 is determined by virtue of the relative positioning of the guide pilot 4 in the guide slot 8. The guide pilot 4 moves along the guide slot 8 as a function of the unwinding of the ribbon roll and markings M are applied to the slot 8 corresponding to guide slot 8 in the cover to facilitate reading by the operator.

Figure 5:
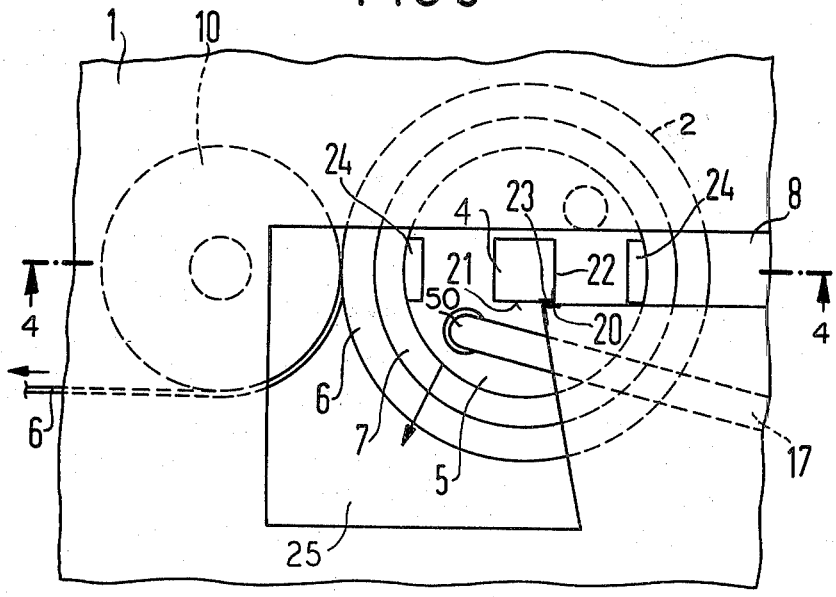
FIG. 5 is a fragmentary plan view of the control edge and guide pilots in connection with the switching device of the present invention immediately before the monitoring device is tripped.

During unwinding of the ribbon 6 from the feed spool 2 onto the take-up spool 3, the roll of ribbon supply on the feed spool 2 becomes smaller and the guide pilot 4 of the feed spool 2 moves along the guide slot 8 toward a predetermined control or decision edge 20 arranged in the slot 8. As shown in FIG. 5, the guide pilot 4 has a square plan profile formed with a straight sliding surface 21 and a correspondingly transverse or lateral face 22. Profile shapes other than square, such as rectangular or trapezoidal, providing a straight sliding surface and corresponding lateral face may also be used for the guide pilot 4. The lateral face 22 and the sliding surface 21 meet at a trailing corner portion of the guide pilot 4 to define a switching or a limit edge 23. As a result of the acute-angled or cornered design of the edge 23, a defined pivoting of the feed spool 2 under the effect of the bias of the spring 17 occurs only until after the switching or limit edge 23 overshoots the control 20. Further sliding surfaces, in the form of pins 24, are additionally arranged in the hub 5 on both sides of the guide pilot 4 to hold the hub 5 against rotational movement as the feed spool 2 travels along the guide slot 8. The feed spool 2 passes along the line of the slot 8 during unwinding of the ribbon roll in a free, straight line sliding manner until switching operation occurs and no clamping forces occur before the switching process.

Figure 3:
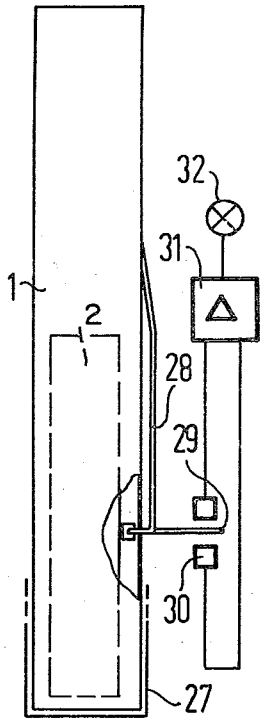
FIG. 3 is a side elevational view of the typewriter ribbon cassette housing of FIG. 1, showing a monitoring device.
Figure 2:
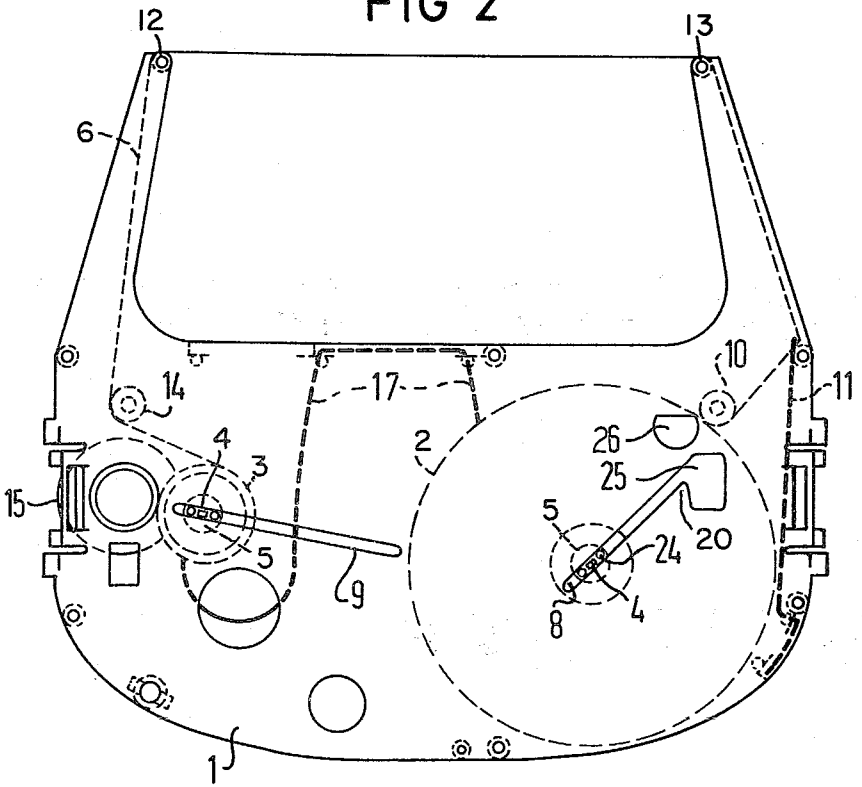
FIG. 2 is a bottom view of the typewriter ribbon cassette housing of FIG. 1.
Figure 4:
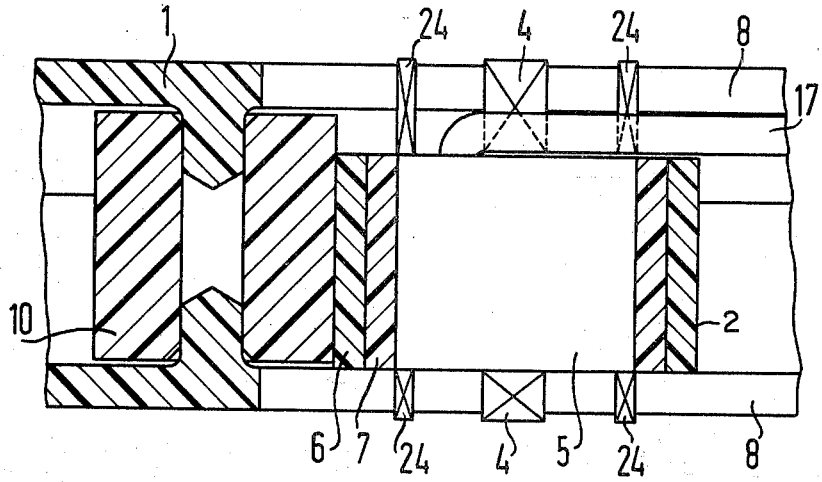
FIG. 4 is a cross-sectional view taken along the lines IV—IV of FIG. 5.

When the switching edge 23 passes beyond the control edge 20, the hub 5 of the feed spool 2 pivots into an enlarged opening region 25 formed in the cartridge housing 1 at the end of the guide slot 8. On the underside of the housing 1, there is formed a further opening 26 into which a spring element 28 engages under a biasing force and rests against the ribbon roll of the feed spool 2. The spring element 28 is preferably part of a cassette unit 27 for containing the supply roll, as shown in FIG. 3, and the spring element 28 rests on the ribbon roll when a supply roll is locked into the cassette unit 27. The opening 26 is formed in the housing 1 such that, when the hub 5 of the feed spool 2 pivots into the enlarged opening 25, the opening 26 is cleared by the ribbon roll, signalling an "end of tape" state of the ribbon roll. At this point, the spring element 28 is directed further into the opening 26.

The spring element 28 is part of a monitoring device, shown in FIG. 3, for generating a signal to the operator indicating the end of the ribbon roll on the feed spool 2 and/or for providing an automatic disconnect feature to operation of the ribbon feed or typewriter. The spring element 28 is formed with an extension portion 29 facing away from the opening 26 and movable, under action of the spring element 28, into and out of a monitoring device control circuit. When the spring element 28 passes fully into the opening 26, during switching operation, the extension portion 29 releases the signal path of an optical-electrical device from a light emitter 30 connected to an assigned amplifier device 31. The amplifier device 31 triggers a signal device 32 in a conventional known manner to indicate the "end of tape" state of the ribbon roll. The ribbon cassette unit 27 can then be removed for reloading from the housing 1 by releasing suitable locking elements 33.

Although various minor modifications may be suggested by those versed in the art, it should be understood that we wish to embody within the scope of the patent warranted hereon all such modifications as reasonably and properly come within the scope of our contribution to the art.

We claim as our invention:

1. A typewriter ribbon cartridge assembly comprising a housing having a feed spool containing section and a take-up spool containing section, at least one said section having a guide slot for receiving a hub of a corresponding spool, biasing means for passing said hub along said guide slot toward one end thereof, a control edge at said one end of said guide slot leading to an enlarged opening formed in said housing, guide pilot means formed on said hub for slidably disposing said hub in said guide slot and pivoting said hub into said enlarged opening under the force of said biasing means, and a monitoring means for signalling when said hub is pivoted into said enlarged opening.

2. The ribbon cartridge assembly of claim 1, wherein said guide pilot means is formed with a straight surface for sliding along said guide slot and control edge and a transverse surface for defining a trailing corner with said straight surface, such that said hub does not pivot into said enlarged opening until after said trailing corner passes said control edge.

3. The ribbon cartridge assembly of claim 2, wherein said guide pilot means has a square plan profile.

4. The ribbon cartridge assembly of claim 2, wherein said hub includes front and trailing pin means arranged spaced on corresponding opposed sides of said guide pilot means for preventing rotational movement of said hub in said guide slot until after said trailing corner passes said control edge.

5. The ribbon cartridge assembly of claim 1, wherein said feed spool containing section has said guide slot.

6. The ribbon cartridge assembly of claim 5, wherein said monitoring means includes a spring element biased toward a further opening formed in said housing, said further opening being covered by a ribbon roll in said feed spool containing section during movement of said hub along said guide slot and being cleared when said hub enters said enlarged opening.

7. The ribbon cartridge assembly of claim 5, further comprising a pressure means for applying a braking torque to containing said feed spool section.

8. A switch apparatus for signalling the end of a ribbon roll on a feed spool of a typewriter ribbon cartridge assembly, comprising a housing having a guide slot, a hub supporting said spool having guide pilot means for displacement of said hub along said guide slot, a biasing means for forcing said hub toward one end of said guide slot, a relatively enlarged opening formed in said housing at said one end of said guide slot, and a monitoring means for signalling when said hub enters said enlarged opening.

9. The switch apparatus of claim 8, further comprising a control edge between said guide slot and said enlarged opening, said hub being pivoted into said enlarged opening under the force of said biasing means when said guide pilot means passes said control edge.

10. The switch apparatus of claim 9, wherein said guide pilot means is formed with first and second surfaces defining a trailing corner edge and said hub includes front and trailing pin means spaced on opposed sides of said guide pilot means for preventing rotational movement of said hub in said guide slot until after said corner edge passes said control edge.

11. The switch apparatus of claim 10, wherein said guide pilot means is of square plan profile.

12. The switch apparatus of claim 8, wherein said monitoring means includes a spring element biased toward a further opening formed in said housing, said further opening being covered by a ribbon roll on said feed spool during movement of said hub along said guide slot and being cleared when said hub enters said enlarged opening.

* * * * *